United States Patent [19]

Staedele et al.

[11] Patent Number: 5,058,372

[45] Date of Patent: Oct. 22, 1991

[54] APPARATUS FOR RELEASABLY GRIPPING THE TUBE OF A YARN PACKAGE OF A TEXTILE MACHINE

[75] Inventors: Norbert Staedele, Goeppingen; Martin Hoffman, Nuertingen, both of Fed. Rep. of Germany

[73] Assignee: Zinser Textilmaschinen GmbH, Ebersbach/Fils, Fed. Rep. of Germany

[21] Appl. No.: 509,898

[22] Filed: Apr. 16, 1990

[30] Foreign Application Priority Data

Apr. 14, 1989 [DE] Fed. Rep. of Germany ..... 3912332

[51] Int. Cl.[5] ..... D01H 9/00; B66C 1/42

[52] U.S. Cl. ..... 57/274; 57/275; 57/281; 294/119.3

[58] Field of Search ..... 57/274, 275–276, 57/270, 281; 294/103.1, 119.3, 86.4

[56] References Cited

U.S. PATENT DOCUMENTS

| | | | |
|---|---|---|---|
| 3,171,681 | 3/1965 | Roller | 294/119.3 |
| 3,408,806 | 11/1968 | Fess et al. | 57/274 X |
| 3,667,204 | 6/1972 | Burgermeister et al. | 57/275 |
| 3,831,995 | 8/1974 | Duncan | 294/119.3 |
| 3,844,099 | 10/1974 | Tsuchiyama et al. | 57/270 |
| 4,339,912 | 7/1982 | Close | 294/119.3 X |
| 4,341,067 | 7/1982 | Kondo et al. | 294/119.3 X |

FOREIGN PATENT DOCUMENTS

| | | | |
|---|---|---|---|
| 2249840 | 7/1976 | Fed. Rep. of Germany . | |
| 3004359 | 8/1980 | Fed. Rep. of Germany . | |
| 3036447 | 4/1981 | Fed. Rep. of Germany . | |
| 231815 | 1/1986 | German Democratic Rep. . | |
| 0086741 | 1/1956 | Norway | 294/119.3 |
| 1031868 | 7/1983 | U.S.S.R. | 294/119.3 |

OTHER PUBLICATIONS

*Marzoli Spin Doff*, 1983.

*Primary Examiner*—Daniel P. Stodola
*Assistant Examiner*—William Stryjewski
*Attorney, Agent, or Firm*—Sheft, Pinckney & Sawyer

[57] ABSTRACT

An apparatus for gripping tubes of yarn packages in a textile machine includes a pressurized fluid drive member. The pressurized fluid drive member is fixedly mounted to a support frame and, in one aspect of the invention, extends interiorly of a generally cylindrical fixed component having a pair of diametrically opposed projections formed on its outer surface. A movable component comprising a tube receiving housing for receiving a yarn package tube therein has a pair of detents compatibly configured with the projections on the fixed component for releasably securing the tube receiving housing to the fixed component. In the event of a collision between the tube gripping apparatus and another object, the movable component is non-destructively released from its normal operating position, thereby minimizing the risk that potentially damaging forces will be transmitted to the pressurized fluid member.

9 Claims, 3 Drawing Sheets

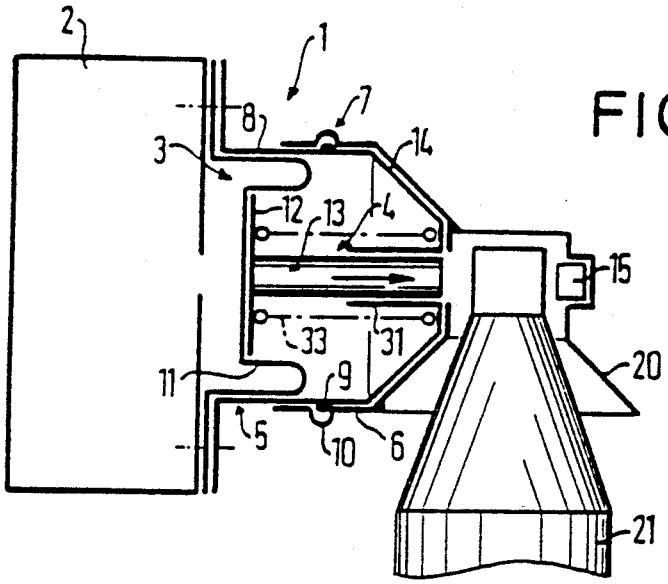
FIG. 1
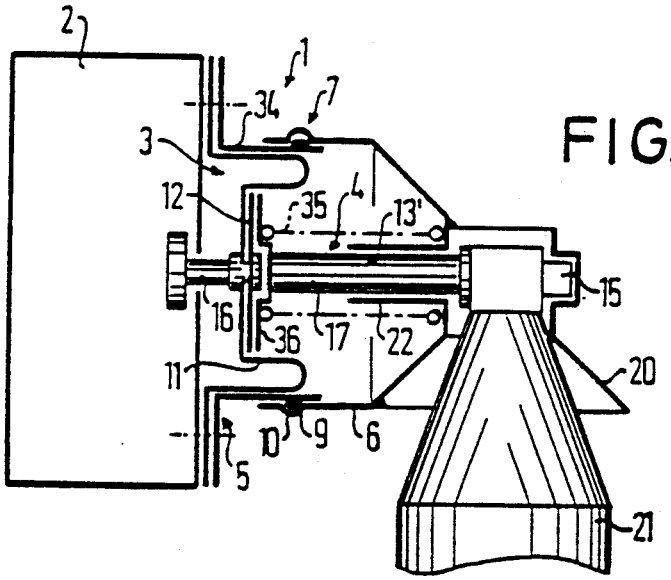
FIG. 2
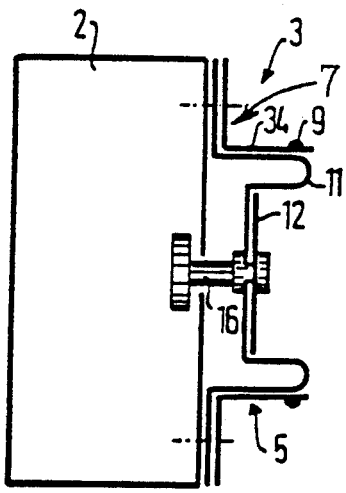
FIG. 3
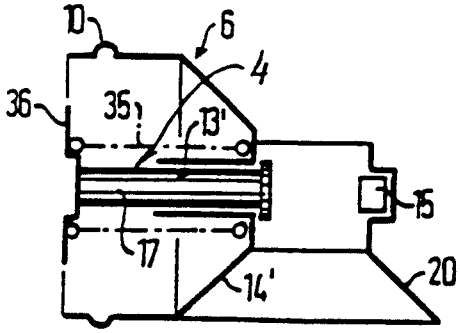

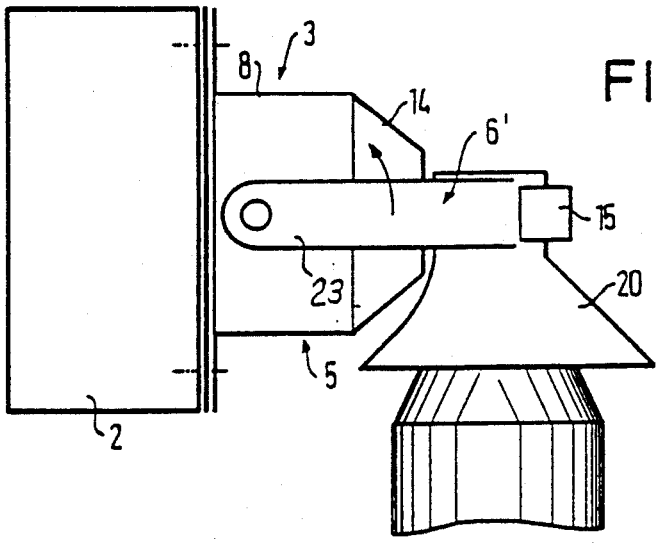
FIG. 4
FIG. 6
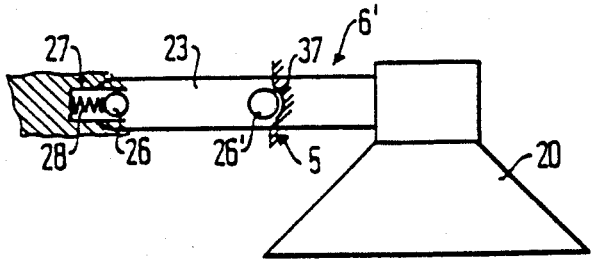
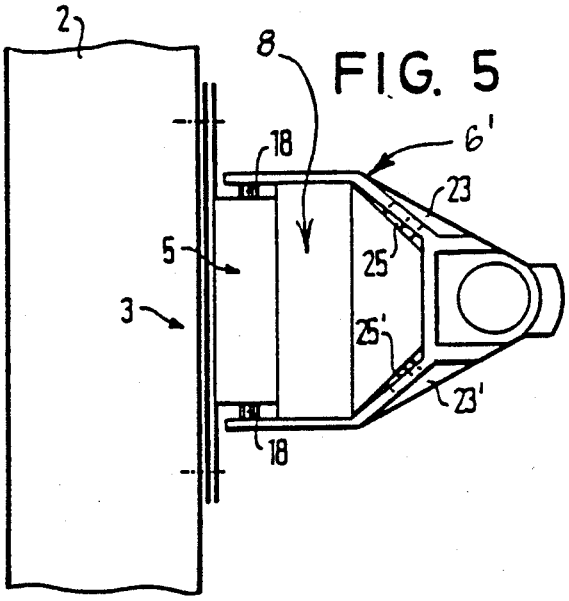
FIG. 5

APPARATUS FOR RELEASABLY GRIPPING THE TUBE OF A YARN PACKAGE OF A TEXTILE MACHINE

BACKGROUND OF THE INVENTION

The present invention relates to an apparatus for releasably gripping the tube of a yarn package of a textile machine.

It is known to provide textile machines with a device for releasably gripping the tube of a yarn package in which the tube gripping device includes a pressurized fluid bladder which serves as a drive means for driving a tube engaging member into engagement with a yarn package tube to thereby effect compressive gripping of the tube by the movable tube engaging member and another tube engaging member. However, experience has shown that if such a tube gripping device is mounted on a movable type service unit such as, for example, an automatic tube exchange unit of a ring spinning machine, collisions between the movable service unit and another object can detrimentally lead to damage to the pressure fluid components. Thus, it has been proposed to movably mount the tube engaging members for movement out of their normal operating area upon impact of the movable service unit with an object. However, experience has shown that damage to the pressurized fluid components can occur due to the movement of the tube engaging members in this manner. Accordingly, the need still exists for an improved apparatus of the type for releasably gripping the tube of a yarn package which can reliably protect the pressurized fluid components in the event of a collision between the apparatus and another object.

SUMMARY OF THE INVENTION

The present invention provides an improved apparatus of the type for releasably gripping the tube of a yarn package which minimizes the likelihood that the pressurized fluid components will be damaged upon impact between the apparatus and another object.

Briefly described, the present invention provides an apparatus for releasably gripping the tube of a yarn package. The apparatus includes a support frame and a tube engaging assembly including a pair of gripping members movable relative to one another to selectively compressively grip therebetween and release the tube of a yarn package, at least one of the gripping members being movable between a gripping position and a release position, and means for movably supporting the at least one movable gripping member for movement between its gripping and release positions. Additionally, the apparatus includes an extendable member selectively extendable to drive the at least one movable gripping member from its release position to its gripping position. Furthermore, the apparatus includes first mounting means for mounting the extendable member to the support frame, and second mounting means for mounting the tube engaging assembly to the support frame independent of the extendable member.

According to one aspect of the present invention, the second mounting means includes means for maintaining a selected one of the gripping members in an operational position for gripping and releasing the tube of a yarn package in cooperation with the other gripping member, the maintaining means permitting nondestructive release of the selected gripping member from the operational position without interference with the extendable member.

According to a different aspect of the present invention, the tube engaging assembly includes a tube receiving housing. The selected gripping member is mounted to the tube receiving housing and the maintaining means permits non-destructive release of the tube receiving housing for movement of the selected gripping member from the operational position. In this different aspect of the present invention, the maintaining means preferably includes a fixed component fixedly mounted to the support frame and a movable component. Additionally, a selected one of the fixed and movable components has a detent and the other of the fixed and movable components has a projection compatibly configured with the detent for releasable receipt therein to releasably maintain the housing and selected gripping member in operational position.

The projection is preferably formed on a portion of said fixed component and the detent is preferably formed on a portion of the movable component. Also, the portion of the fixed component on which the projection is formed is generally cylindrically shaped and the portion of the movable component on which the detent is formed is generally cylindrically shaped and has a diameter relatively slightly greater than the diameter of the generally cylindrically shaped portion of the fixed component. The generally cylindrically shaped portion of the movable component is received on the generally cylindrically shaped portion of the fixed component during receipt of the projection in the detent.

According to a further aspect of the apparatus of the present invention, the extendable member includes a bladder fixedly mounted to the support frame and received within the fixed component of the maintaining means. Also, at least one movable gripping member preferably includes a thrust plate positioned for engagement by the bladder upon extension of the bladder to effect movement of the at least one movable gripping member from its release position to its gripping position.

In another embodiment of the present invention, the maintaining means includes a frusto-conical portion extending from the generally cylindrical portion of the fixed component and tapering inwardly in a direction outwardly from the support frame and the means for movably supporting the at least one movable gripping member is mounted on the frusto-conical portion.

In one embodiment of the present invention, the generally cylindrically shaped portion of the fixed component extends relatively closely adjacent the support frame and the generally cylindrically shaped portion of the movable component circumferentially encloses the generally cylindrically shaped portion of the fixed component at the circumferential location of the projection.

In a further embodiment of the present invention, the means for movably mounting the tube receiving housing includes means for pivotally mounting the tube receiving housing to the fixed component. Preferably, the means for movably mounting the tube receiving housing includes a pair of spaced, generally parallel arm members and means for pivotally connecting each arm-member to the fixed component.

Also, in the further embodiment, the fixed component is preferably formed with a pair of detents, each arm member is formed with a projection compatibly configured with a respective one of the detents for releasable receipt therein, and the fixed component includes a pair of guide slots. Each arm member includes a guide pin compatibly configured with a respective one of the guide slots for sliding receipt therein and means for biasing the guide pins outwardly of the guide slots, whereby the projections of the arm members are received in the fixed component detents and the guide pins are received in the guide slots in the operational position of the other gripping member. In yet another embodiment of the present invention, the second mounting means includes means for mounting the tube engaging assembly directly to the support frame. Also, the at least one movable gripping member is preferably supported at a spacing from the extendable member and characterized further in that the tube engaging assembly includes means engagable by the extendable member and engageable with the at least one movable gripping member for moving the at least one movable gripping member in response to extension of the extendable member.

BRIEF DESCRIPTION OF THE DRAWINGS

FIG. 1 is a vertical sectional view of one embodiment of the tube gripping apparatus of the present invention;

FIG. 2 is a vertical sectional view of another embodiment of the tube gripping apparatus of the present invention, showing the tube engaging assembly thereof in its operational position;

FIG. 3 is a vertical sectional view of the tube gripping apparatus shown in FIG. 2 and representatively showing the tube engaging assembly thereof in a removed position;

FIG. 4 is a side elevational view of a further embodiment of the tube gripping apparatus of the present invention;

FIG. 5 is a plan view of the tube gripping apparatus shown in FIG. 4;

FIG. 6 is a side elevational view of the tube engaging assembly and a portion of the fixed component of a modified form of the tube gripping apparatus shown in FIG. 4.

DETAILED DESCRIPTION OF THE PREFERRED EMBODIMENTS

Figure 7:
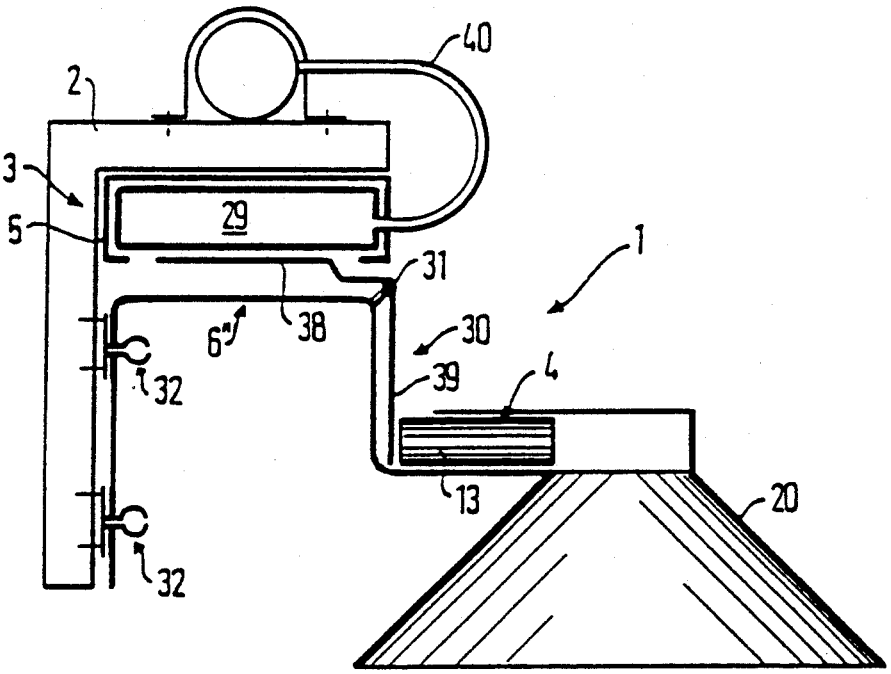
FIG. 7 is a vertical sectional view of an additional embodiment of the tube gripping apparatus of the present invention.

In FIG. 1, one embodiment of the tube gripping apparatus of the present invention is illustrated and is generally designated as 1. The tube gripping apparatus 1 includes a support frame 2 adapted to be mounted in conventional manner to, for example, a movable-type service unit for executing tube exchange operations at the stations of a textile machine such as, for example, a ring spinning machine. The tube gripping apparatus 1 additionally includes an extendable member 3 which can include, for example, a conventional bladder 11 adapted to selectively expand upon the introduction of pressurized fluid thereto by conventional conduit means (not shown) communicated with a conventional pressurized fluid source (not shown). One portion of the bladder 11 is rigidly mounted to the support frame 2.

The tube gripping apparatus 1 further includes a tube engaging assembly having a pair of gripping members 4,15 movable relative to one another to selectively compressively grip and release the tube of a yarn package 21. The gripping member 4 is movable between a gripping position and a release position and the gripping member 15 is stationary. The gripping member 4 is configured as a rod 13 movable between a release position and a gripping position spaced closer to the other gripping member 15.

The rod 13 is movably supported in a cylindrical guide means 31 formed in a fixed component 8. The fixed component 8 includes a generally cylindrical portion and a frusto-conical portion extending from the generally cylindrical portion and tapering inwardly in a direction laterally outwardly with respect to the support frame 2.

The tube gripping apparatus additionally includes first mounting means for mounting the tube engaging assembly to the support frame 2 independent of the extendable member 3. The mounting means includes means for maintaining a selected one of the gripping members 4,15 in an operational position in which the selected gripping member is disposed for gripping and releasing the tube of the yarn package 21 in cooperation with the other gripping member. The maintaining means permits non-destructive release of the selected one gripping member from its operational position without interference with the extendable member 3. The maintaining means includes a fixed component 8 and a movable component 7.

The movable component 7 includes a generally cylindrical portion of a diameter slightly greater than the diameter of the generally cylindrical portion of the fixed component 8. Additionally, the movable component 7 includes a frusto-conical portion extending from its generally cylindrical portion and compatibly configured with the frusto-conical portion of the fixed component 8 to extend in generally superposed relation therewith in the operational position of the gripping members 4,15. A tube receiving housing 6 having a conical portion 20 is mounted to the frusto-conical portion of the movable component 7 and the gripping member 15 is mounted in the conical portion 20.

The fixed component 8 includes a pair of projections 9 on diametrically opposite locations on the outer surface of its generally cylindrically portion. The movable component 7 includes a pair of detents 10 formed in diametrically opposite locations on its generally cylindrical portion. Each projection 9 is compatibly configured with a respective one of the detents 10 for receipt of the projection in the detent to releasably secure the movable component 7 to the fixed component 8. The fixed component 8 is fixedly secured to the support frame 2.

A thrust plate 12 is secured to the end of the rod 13 adjacent the bladder 11 for engagement by the bladder. A means for biasing the gripping member 4 in its release position is provided in the form of a spring 33 compressively disposed between the fixed component 8 adjacent the cylindrical guide means 31 and the thrust plate 12.

In the normal operating position of the gripping member 15 in which the gripping member is disposed for compressively gripping the tube of the package 21 in cooperation with the gripping member 4, the movable component 7 is releasably secured to the fixed component 8 through the receipt of the projections 9 in the detents 10. During a normal tube gripping operation, pressurized fluid is conducted by the pressurized fluid conduit from the pressurized fluid source to the bladder 11 to effect expansion of the bladder 11. The bladder 11 extends interiorly of the fixed component 8 and, through continuous engagement with the thrust plate 12, effects movement of the rod 13 relative to the cylindrical guide means 31. Accordingly, the gripping member 4 is moved by the extendable member 3 from its release position to its gripping position for compressively gripping the tube in cooperation with the gripping member 15.

In the event that the tube gripping apparatus 1 sustains an impact such as, for example, during lowering of the tube receiving housing 6 onto the top of a yarn package tube to be gripped, the movable component 7 is non-destructively released from the fixed component 8 as the detents 10 slide relative to their respective received projections 9 and, accordingly, the tube receiving housing 6 moves relative to the fixed component 8 out of its normal operating position. Impact forces on the movable component 7 are accordingly not transmitted to the extendable member 3 but are, instead, substantially absorbed through movement of the movable component 7.

In FIGS. 2 and 3, another embodiment of the tube gripping apparatus of the present invention is illustrated and is generally designated as 1. The tube gripping apparatus 1 includes a support frame 2. An extendable member 3 has a bladder 11 and a portion of the bladder is rigidly fixedly mounted to the support frame 2. A fixed component 34 having a generally cylindrical portion is fixedly mounted to the support frame 2 and a pair of projections 9 are formed on the generally cylindrical portion at diametrically opposite locations thereon. A movable component 7 includes a generally cylindrical portion compatibly configured for receipt on the generally cylindrical portion of the fixed component 34 and includes a pair of detents 10 at diametrically opposite locations, each detent 10 being compatibly configured to receive a respective one of the projections 9 therein. A cylindrical guide means 22 is formed on the movable component 7 for movably supporting a rod 13' of a gripping member 4. A thrust plate 36 is fixedly mounted to one end of the rod 13' and a spring 17 is compressively disposed between the movable component 7 and the thrust plate 36 for biasing the rod 13' in a direction toward the bladder 11. The rod 13' includes a cylindrical portion 17.

The extendable member 3 additionally includes a thrust plate engaging member 16 projecting outwardly from the bladder 11 and having a portion 12 compatibly configured with the thrust plate 36 for nesting engagement therewith. The thrust plate 36 moves laterally outwardly relative to the support frame 2 out of engagement with the thrust plate engaging member 12 of the extendable member 3 during movement of the movable component 7 relative to the fixed component 34.

As seen in FIG. 3, the movable component 7 in the embodiment of the tube gripping apparatus illustrated in FIGS. 2 and 3 supports both gripping members 4,15. In the event that the movable component 7 sustains an impact, the movable component is non-destructively released from the fixed component 34 through relative movement of the detents 10 past their respective projections 9. Thus, the bladder 11, and other components of the extendable member 3, do not sustain the transmission of any potentially damaging forces due to the impact of the movable component 7 with another object.

In FIGS. 4 and 6, a further embodiment of the tube gripping apparatus of the present invention is illustrated and is generally designated as 3. The tube gripping apparatus 3 includes a supporting frame 2 and a fixed component 8 rigidly fixedly mounted to the supporting frame 2 in extendable member (not shown) is disposed interiorly of the fixed component 8 and a portion thereof is rigidly fixedly mounted to the supporting frame 2. The fixed component 8 includes a generally cylindrical portion 5 and a frusto-conical portion 14 extending from the generally cylindrical portion 5 and tapering in the direction laterally outwardly from the supporting frame 2.

The tube gripping apparatus additionally includes a movable component 6' having a pair of spaced, generally parallel arm members 23,23' pivotally connected by a pair of pivot means 18 to the generally cylindrical portion 5 of the fixed component 8 at diametrically opposed locations thereon. Each arm 23,23' is fixedly connected to a tube receiving housing 20 in which a gripping member 15 is mounted. The other gripping member (not shown) is movably supported interiorly of the fixed component 8 and is movable by the extendable member from a release position to a gripping position in which the pair of gripping members compressively grip the tube of a package 21.

As best seen in FIG. 5, the generally cylindrical portion 5 of the fixed component 8 has a pair of projections 25, 25' each compatibly configured with a detent formed on one of the arms 23, 23', respectively.

In normal operation, the movable component 6' is disposed in the position shown in FIG. 4 in which the projections 25, 25' are received in their respective detents. In the event that the movable component 6' collides with another object, the movable component moves relative to the fixed component 8 during pivoting about the pivot means 18 and the detents slide past their respective projections 25, 25' whereby the moving component 6' is non-destructively released for limited movement relative to the extendable member 3 which is disposed in the fixed component 8. Additionally, the springs 28 push the post 26 out of the guide slots 27, thereby effecting complete separation of the movable component 6' from the fixed component 8.

In FIG. 6, one variation of the embodiment of the tube gripping apparatus 3 shown in FIGS. 4 and 5 is illustrated in which the shafts 18 are deleted and, in lieu thereof, each arm 23,23' is provided with a post 26 (only one of which is shown) compatibly configured with a guide slot 27 (only one of which is shown) formed in the generally cylindrical portion 5 of the fixed component 8. A spring extends between each post 26 and the closed end of the guide slot 27 to bias the movable component 6' outwardly relative to the support frame 2.

Additionally, the generally cylindrical portion 5 of the fixed component 8 has a pair of detents 37 formed thereon at diametrically opposite locations (only one of which is shown). Each arm 23,23' such as, for example, the arm 23 has a projection 26' formed thereon and located for receipt in a respective one of the detents 37 in the normal operating position of the movable component 6'.

When the movable component 6' impacts another object, the arms 32,23' pivot about the pivot shaft 18 and the detents formed on the arms 23,23' move out of receiving engagement with the projections formed on the fixed component 8.

In FIG. 7, an additional embodiment of the tube gripping apparatus of the present invention is illustrated and is generally designated as 1. The tube gripping apparatus 1 includes a support frame 2. A fixed component 5 includes an open interior for receiving the bladder 29 of an extendable member 3 to retain the bladder 29 in a fixed disposition relative to the support frame 2. The extendable member 3 additionally includes a pressure source conduit 40 communicating the bladder 29 with a conventional pressure fluid source. The tube gripping apparatus 1 additionally includes a tube engaging assembly 6''. A first mounting means for independently mounting the tube engaging assembly 6'' to the support frame 2 includes a plurality of post members 32 having radially enlarged free end portions extending from the support frame 2 and a plurality of compatibly located openings in the tube engaging assembly 6'' for receiving the post members 32 therethrough.

The tube engaging assembly 6'' includes a tube receiving housing 20 for receiving the tube of a yarn package to be gripped therein, a movable gripping member 4 having a rod 13 and another gripping member (not shown) for cooperating with the movable gripping member 4 to compressively grip the tube of a yarn package. A means for transmitting movement of the bladder 29 to the movable gripping member 4 includes a bell crank 31 pivotally connected to the tube engaging assembly 6''. The bell crank 31 includes a first arm 38 projecting adjacent the bladder 29 for engagement thereby and a second arm 39 projecting adjacent the rod 13 of the movable gripping member 4 for engaging the movable gripping member.

In normal tube gripping operation, pressurized fluid is introduced from the pressurized fluid source through the pressurized fluid conduit 40 to the bladder 29 to cause expansion of the bladder. The expanding bladder 29 pushes on the first arm 38 of the bell crank 31 to cause corresponding movement of the second arm 39. The rod 13 of the movable gripping member 4 moves from its release position to its gripping position in response to movement of the second arm 39. In the event that the tube engaging assembly 6'' impacts another object, it is non-destructively released from its mounted disposition on the support frame 2 as the openings on the tube engaging assembly clear the enlarged radial free end portions of the post members 32, thereby complete releasing the tube engaging assembly 6'' from its connection with the support frame 2.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for selectively gripping the tube of a yarn package, comprising:

a support frame;

a tube engaging assembly including a pair of gripping members, at least one gripping member being movable between a gripping position in which it cooperates with the other gripping member to compressively grip the tube of a yarn package therebetween and a non-gripping position in which said at least one movable gripping member and the other gripping member are out of gripping engagement with the tube of a yarn package, and means for movably supporting said at least one gripping member for movement between its gripping and non-gripping positions;

an extendable member selectively extendable into an extended position in which it maintains said at least one gripping member in its gripping position;

means for mounting said extendable member to said support frame for extending movement of said extendable member into its extended position; and means for releasably mounting a selected portion of said tube engaging assembly to said support frame in a mounted position, said releasably mounting means being operable to non-destructively release said selected portion of said tube engaging assembly from said mounted position for movement of said selected portion out of interference with said extendable member to a release position in response to the application of a predetermined force against said selected portion of said tube engaging assembly, whereby the energy of said predetermined force is substantially converted into movement of said selected portion from said mounted position to said release position so as to avoid the undesired transmission to said extendable member of said predetermined force which may tend to displace said extendable member from its extended position.

2. The apparatus according to claim 1 and characterized further in that said selected portion of said tube engaging assembly includes a tube receiving housing and said other gripping member is mounted to said tube receiving housing.

3. The apparatus according to claim 2 and characterized further in that said releasably mounting means includes a fixed component fixedly mounted to said support frame, a selected one of said fixed component and said tube receiving housing having a detent and the other of said fixed and said tube receiving housing having a projection compatibly configured with said detent for releasable receipt therein to releasably maintain said tube receiving housing in a position in which said other gripping member is supported for cooperating with said at least one gripping member to compressively grip the tube of a yarn package therebetween.

4. The apparatus according to claim 3 and characterized further in that said projection is formed on a portion of said fixed component and said detent is formed on a portion of said tube receiving housing.

5. The apparatus according to claim 4 and characterized further in that said portion of said fixed component on which said projection is formed is generally cylindrically shaped and said portion of said tube receiving housing on which said detent is formed is generally cylindrically shaped and has a diameter relatively slightly greater than the diameter of said generally cylindrically shaped portion of said fixed component, said generally cylindrically shaped portion of said tube receiving housing being received on said generally cylindrically shaped portion of said fixed component during receipt of said projection in said detent.

6. The apparatus according to claim 5 and characterized further in that said fixed component of includes a frusto-conical portion extending from said generally cylindrical portion of said fixed component and tapering inwardly in a direction laterally outwardly from said support frame and said means for movably supporting said at least one gripping member is mounted on said frusto-conical portion.

7. The apparatus according to claim 5 and characterized further in that said generally cylindrically shaped portion of said tube receiving housing circumferentially encloses said generally cylindrically shaped portion of said fixed component at the circumferential location of said projection on said fixed component.

8. The apparatus according to claim 1 and characterized further in that said extendable member includes a bladder fixedly mounted to said support frame.

9. The apparatus according to claim 8 and characterized further in that said at least one gripping member has an axis and said means for mounting said extendable member includes means for supporting said at least one gripping member for axial movement between its gripping and non-gripping positions and said bladder is selectively expandable to drive said at least one gripping member from its non-gripping position to its gripping position.

* * * * *